United States Patent [19]

Hanna

[11] 4,226,409

[45] Oct. 7, 1980

[54] MULTIPLE CLAMP AND INDEXABLE ANVIL THEREFOR

[76] Inventor: Arthur W. Hanna, 9706 Wheatland Ave., Sunland, Calif. 91040

[21] Appl. No.: 957,888

[22] Filed: Nov. 6, 1978

[51] Int. Cl.[3] ..... B25B 1/20

[52] U.S. Cl. ..... 269/41; 269/154; 269/283; 269/910

[58] Field of Search ..... 269/41–42, 269/152–155, 321 S, 279–280, 283, 97

[56] References Cited

U.S. PATENT DOCUMENTS

| | | | |
|---|---|---|---|
| 906,507 | 12/1908 | Canedy | 269/279 |
| 1,081,311 | 12/1913 | Joachimson | 269/42 |
| 2,636,527 | 4/1953 | Schiemann | 269/97 |
| 2,941,557 | 6/1960 | Baprawski | 269/41 |

FOREIGN PATENT DOCUMENTS

| | | | |
|---|---|---|---|
| 561201 | 8/1958 | Canada | 269/41 |
| 2620658 | 11/1977 | Fed. Rep. of Germany | 269/41 |

*Primary Examiner*—Robert C. Watson

*Attorney, Agent, or Firm*—Fulwider, Patton, Rieber, Lee & Utecht

[57] ABSTRACT

A clamping device for simultaneously holding a plurality of workpieces is provided and includes a pair of movable jaws which hold the workpieces against an integral fixed jaw having bearing faces directed toward each movable jaw. The device is lightweight and includes work engaging supports remote from the fixed jaw to facilitate orienting the device in any desired position on the work. An indexable anvil can be disposed over the fixed jaw to accommodate irregularly shaped workpieces, and an alternative embodiment of the device is arranged to hold the workpieces at any desired angle with respect to one another.

7 Claims, 6 Drawing Figures

MULTIPLE CLAMP AND INDEXABLE ANVIL THEREFOR

BACKGROUND OF THE INVENTION

The present invention relates to clamping devices for holding a plurality of workpieces together, and more particularly, to such a device for releasably holding a pair of workpieces at any desired angle with respect to one another.

It is highly desirable to be able to secure workpieces together at a fixed angle with respect to one another by a clamping device that can be supported on and quickly and easily oriented in any desired position with respect to the workpieces being clamped. Further, it is desirable to be able to hold workpieces having irregularly shaped external surfaces, and to be able to hold workpieces at any desired angle with respect to one another.

Various clamping devices for holding workpieces at right angles have been known for a number of years, and by way of example, one of such devices can be seen in U.S. Pat. No. 121,851 to Cornish. These devices are generally used for joining mitered corners of wood pieces such as molding, picture frames, and the like.

These prior clamping devices are generally constructed of a heavy frame having upstanding flanges to engage the interior faces of the work to be joined, and movable jaws operated by a threaded shaft to hold the work against the flanges. The movable jaws are ordinarily guided in tracks, and are subject to binding and malfunction if the device is oriented other than on a generally horizontal surface. Further, these devices are bulky and unwieldy, and are generally intended for use only on work pieces weighing less than the clamping device.

Accordingly, there has existed a need for a convenient and effective clamping device which can be quickly and easily oriented in any desired position on the workpieces to be clamped, and can be further adapted for use with workpieces having irregularly shaped external surfaces. As will become apparent from the following, the present invention satisfies this need.

SUMMARY OF THE INVENTION

The present invention provides a lightweight clamping device of greatly simplified construction which can be used to quickly and easily secure workpieces together at any desired angle. The device can be used either resting on a horizontal surface or in other positions, and because of its light weight, the clamping device can be entirely supported by the work. Further, the clamping device of the present invention can be adapted for engaging workpieces having irregularly shaped external surfaces. A preferred embodiment of the invention is prearranged for securing workpieces at right angles to one another, and an alternative embodiment of the invention is adapted for clamping workpieces at any desired angle with respect to one another.

More specifically, in the presently preferred embodiment of the invention the clamping device includes an L-shaped base having an upstanding fixed jaw at the corner of the base and a pair of movable jaws on each arm of the L-shaped base. The movable jaws are screws threaded in an upstanding post at the ends of each arm, and the screws are movable toward and away from the fixed jaw for holding workpieces disposed between the movable and fixed jaws.

In order to allow the clamping device to be quickly and easily mounted on a workpiece in any desired orientation therewith, a supporting tab extends laterally from the end of each arm and has an upper surface in the piece and properly orienting the clamping device. The fixed jaw is preferably square and has a generally flat vertical surface facing each movable jaw.

In order to arrange the device for clamping workpieces having an irregularly shaped external surface, an indexable anvil can be disposed over the fixed jaw, which anvil has a plurality of non-planar external surfaces for cooperating with various workpieces. The anvil includes a square vertical opening through its center which allows the anvil to be placed over the square fixed jaw with any desired external surface facing either of the movable jaws.

An alternative embodiment of the present invention includes a pair of lightweight clamping devices pivotally connected adjacent their fixed jaws for holding workpieces at any desired angle with respect to one another. This arrangement can include a means for locking and unlocking the pivoted connection so that the clamping devices can be secured in any desired angular position with respect to one another.

Other features and advantages of the present invention will become apparent from the following detailed description, taken in conjunction with the accompanying drawings, which illustrate, by way of example, the principles of the invention.

DETAILED DESCRIPTION

Figure 1:
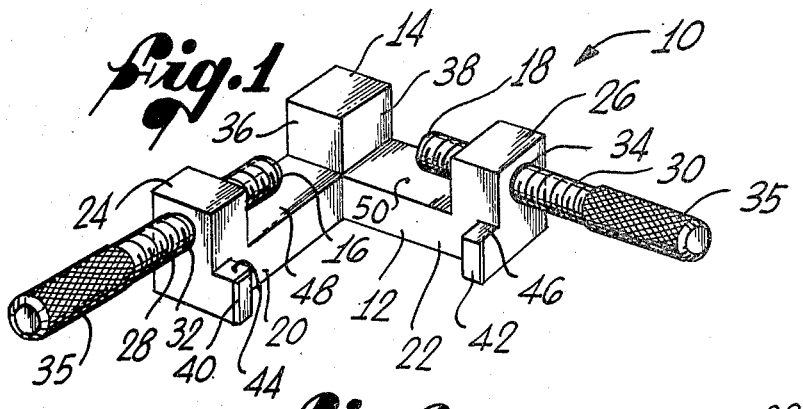
FIG. 1 is a perspective view of a clamping device embodying the present invention.

As shown in the exemplary drawings, a clamping device, indicated generally by reference numeral 10 in FIG. 1, is provided for clamping a plurality of workpieces at right angles with respect to one another. The device is constructed generally of an L-shaped base 12 having a fixed jaw 14 upstanding from the corner of the base, and a pair of movable jaws 16 and 18 supported on the base 12 and movable toward and away from the fixed jaw 14 for holding workpieces between the movable and fixed jaws.

The base 12 is formed of a pair of arms 20 and 22 extending from the bottom of the fixed jaw 14 at a right angle to each other. Each arm has an upstanding post 24 and 26 at its distal end for supporting a threaded screw 28 and 30 which is arranged to move the movable jaws 16 and 18. In this instance, the movable jaws are simply the forward ends of the screws 28 and 30.

For the purpose of moving the screws 28 and 30 toward and away from the fixed jaw 14, the posts 24 and 26 each have an internally threaded aperture 32 and 34 aligned with the fixed jaw 14 which cooperate with the external threads on the screws 28 and 30. The outer end of the screws can be knurled, as at 35, to facilitate manual rotation of the screws. In order to cooperate with the movable jaws 16 and 18 for holding a workpiece, the fixed jaw 14 is provided with a generally flat vertical clamping surface 36 and 38 facing in the direction of each of the arms 20 and 22. Preferably, the surfaces 36 and 38 of the fixed jaw 14 are no wider than the arms 20 and 22, thereby providing a compact and easily manipulated clamping device 10 not available heretofore.

Figure 2:
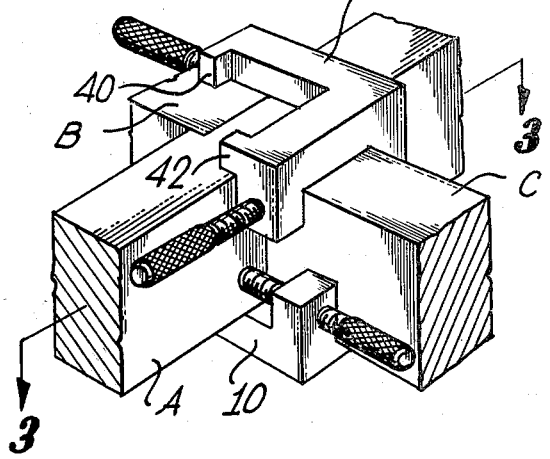
FIG. 2 is a perspective, partly fragmentary view of a pair of clamping devices embodying the present invention, and illustrated as used for holding a plurality of workpieces at right angles to one another.
Figure 3:
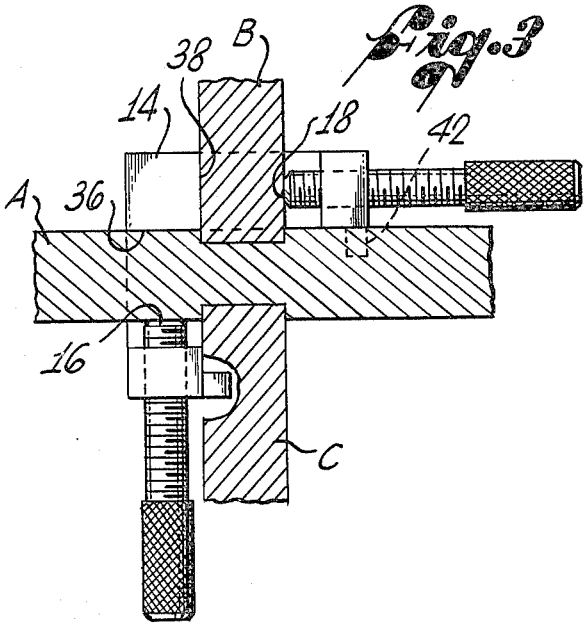
FIG. 3 is an enlarged, fragmentary, partly sectional view of one of the clamping devices of FIG. 2, and taken generally along line 3—3 of FIG. 2.

As can best be seen in FIGS. 2 and 3, the clamping device 10, constructed in accordance with the present invention, can be used in any desired orientation to join a pair of generally flat workpieces at right angles to one another. To facilitate orienting the device 10 for proper gripping of the pieces to be held, a support tab 40 and 42 extends laterally from the end of each arm and has a flat upper surface 44 and 46 lying in the same plane as the top surface 48 and 50 of the arms 20 and 22. By this arrangement, when the device 10 is placed on the workpieces to be clamped, the tabs 40 and 42 engage the work at a position remote from the fixed jaw 14 thereby quickly and easily aligning the device in its proper position for clamping the workpieces.

It will be appreciated that the tab 42 will also serve to inhibit the tendency of a workpiece to rotate when being clamped between the movable jaw 16 and the surface 36. If desired, the screw 30 can be provided with left hand threads so that the tab 40 can serve a similar additional purpose.

As illustrated in FIG. 2, a pair of clamping devices 10 can be used to secure several workpieces at right angles with respect to one another. In this instance, each of the devices 10 is holding a first workpiece A in engagement with one of two abutting workpieces B and C. More specifically, the lower clamping device 10 is illustrated holding the workpieces A and B, and the upper clamping device is illustrated holding the workpieces A and C.

The manner in which this is accomplished can best be seen in FIG. 3, showing the lower clamping device 10 and its engagement with the workpieces A and B. In that view it can be seen that the workpiece A is tightly held between the face 36 of the fixed jaw 14 and the movable jaw 16. Also, it will be noted that the workpiece A passes over the tab 42 and engages the upper surface 46 thereof. In order to clamp the workpiece B at a right angle to the workpiece A, the workpiece B is held between the face 38 of the fixed jaw 14 and the movable jaw 18.

The upper clamping device 10 is secured to the workpieces A and C in the same manner as described in connection with the lower device. As viewed in FIG. 2, the tabs 40 and 42 can be seen to engage the top surface of the workpieces. Accordingly, the operation of the tabs 40 and 42 to assist in orienting the device 10 is clearly illustrated.

Since the clamping device 10 is constructed of relatively light material, such as aluminum, it will be appreciated that the device can easily be placed in any desired orientation with respect to the work. Further, the devices 10 are light enough to easily be supported by the workpieces on which they are mounted.

In order to retain objects having other than a flat exterior surface in the clamping device 10, an indexable anvil 52 can be disposed over the fixed jaw 14 thereby providing a clamping surface on the fixed jaw having any desired non-planar configuration. To fit over the fixed jaw 14, the anvil 52 has a square passage 54 disposed vertically therethrough and being sized to fit loosely over the fixed jaw 14.

Figure 4:
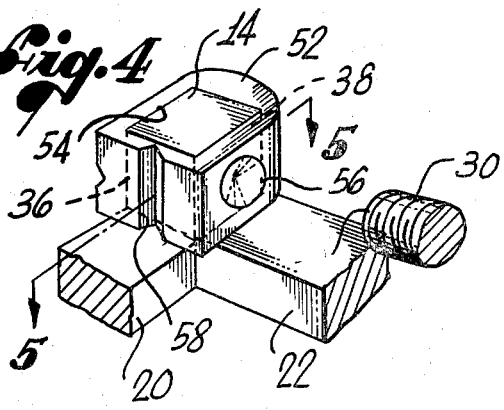
FIG. 4 is a fragmentary perspective view of a fixed jaw of a clamping device embodying the present invention, and illustrated having an indexable anvil disposed thereover.

As illustrated in FIG. 4, the indexable anvil 52 is a body having four laterally facing external walls, and each wall is arranged with a different non-planar surface. The anvil 52 is shown oriented so that a lateral face having a generally conical recess 56 is disposed over the face 38 of the fixed jaw 14. The recess 56 can be used to engage an object having a convex external surface, such as a sphere. Disposed over the face 36 of the fixed jaw 14 is a lateral face of the anvil 52 having a vertically oriented V-shaped groove 58 therein. The groove 58 can be used, for example, to engage a cylindrically shaped object.

Figure 5:
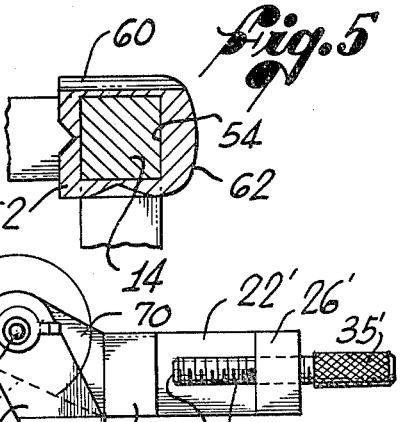
FIG. 5 is a fragmentary cross-sectional view of the indexable anvil of FIG. 4, and taken generally along line 5—5 of FIG. 4.

As can best be seen in FIG. 5, the other external faces of the anvil 52 are provided with a horizontally oriented V-shaped groove 60, and a generally convex surface 62. In order to orient the anvil 52 so that any desired lateral surface faces a particular movable jaw, the anvil can be lifted off of the fixed jaw 14, turned to the desired position and lowered back on to the fixed jaw 14.

Of course, any desired configuration can be provided on the various lateral faces of the anvil 52, and the anvil can be inverted and placed over the fixed jaw 14 so that, for example, the V-shaped groove 58 is disposed over the face 38 and the conical recess 56 is disposed over the face 36. If desired, any of the above recesses can be formed in one of the faces 36 or 38 of the fixed jaw 14.

Figure 6:
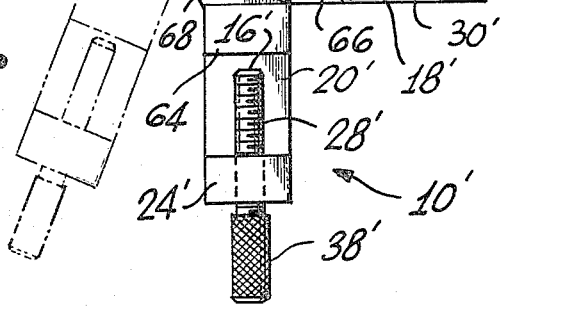
FIG. 6 is a plan view of an alternative embodiment of the present invention which is arranged to clamp workpieces at any desired angle with respect to one another.

An alternative embodiment of the present invention is illustrated in FIG. 6. In this instance, the clamping device 10′ is similar to the device discussed in connection with FIGS. 1 through 3, and parts of the clamping device of FIG. 6, which finds substantial correspondence in structure and function to those previously discussed in connection with FIGS. 1 through 3, have been designated with corresponding primed reference numerals.

The clamping device 10′ includes a pair of arms 20′ and 22′ having upstanding posts 24′ and 26′ which receive threaded screws 28′ and 30′. The outer end of the screws are knurled, as at 35′, to facilitate manual rotation of the screws for advancing and retracting the movable jaws 16′ and 18′.

The inner end of each of the arms 20′ and 22′ has a fixed jaw 64 and 66 upstanding therefrom for clamping cooperation with the movable jaws 16′ and 18′. However, the fixed jaws 64 and 66 are not formed integrally with one another as is the fixed jaw 14 discussed above.

Rather, the fixed jaws 64 and 66 are pivotally connected to one another by a pair of hinge arms 68 and 70. The hinge arm 70 extends from the bottom of the fixed jaw 66 opposite the arm 22′, and the hinge arm 68 extends from the fixed jaw 64, opposite the arm 20′, and overlying the hinge arm 70.

A hinge pin 72 extends through an aperture formed through both of the hinge arms 68 and 70 to pivotally connect the hinge arms. By this arrangement, the arms 20′ and 22′ can be rotated to any desired position with respect to one another, as indicated by the arrow in FIG. 6, for clamping a pair of workpieces at any desired angle with respect to each other.

The hinge pin 72 preferably fits loosely through the aperture in the upper hinge arm 68 and is threaded into the aperture in the lower hinge arm 70. By this arrangement, a winged head 74 on the hinge pin 72 can be turned in one direction to lock the hinge arms 68 and 70 together, and turned in the opposite direction to free the hinge arms 68 and 70 for relative rotation.

From the foregoing, it will be appreciated that the present invention provides a lightweight and greatly simplified clamping device which can be used in any desired orientation to quickly and easily secure workpieces together at right angles. Further, the clamping device of the present invention is relatively inexpensive to manufacture, can be adapted for engaging workpieces having irregularly shaped external surfaces, and an alternative embodiment of the invention is adapted for clamping workpieces at any desired angle with respect to one another.

While several particular forms of the invention have been illustrated and described, it will also be apparent that various modifications can be made without departing from the spirit and scope of the invention.

I claim:

1. A clamping device comprising:

an L-shaped base including a pair of arms each having a generally flat upper surface for engaging a workpiece, said arms being disposed at a right angle to one another in a generally horizontal plane;

a fixed jaw upstanding from said base at the intersection of said arms, said jaw having a generally flat vertical clamping surface facing in the direction of each of said arms;

a screw supporting post upstanding from the distal end of each of said arms, each of said posts having a threaded aperture therethrough parallel to said arm and directed toward said fixed jaw;

a threaded screw received in each of said apertures and arranged to cooperate therewith for holding a workpiece against said fixed jaw; and a supporting tab extending from each of said arms generally adjacent said screw supporting post and in a direction parallel to the other of said arms, each of said screw supporting posts having a side surface that is coplanar with the clamping surface of said fixed jaw facing in the direction of the other of said arms, and each of said supporting tabs having an upper surface that is coplanar with the upper surface of the other of said arms, whereby said screw supporting post and said tab of one arm provide support and alignment for the workpiece held in the other of said arms.

2. A clamping device as set forth in claim 1, wherein said L-shaped base includes a generally flat-lower surface and generally flat outer side surfaces for resting said clamping device in a horizontal or a vertical orientation on a generally flat work surface.

3. A clamping device as set forth in claim 2, wherein said fixed jaw defines a solid square post.

4. A clamping device for simultaneously holding a plurality of work pieces, said device comprising:

a first clamping means including an upstanding fixed jaw, a base arm extending longitudinally from the bottom of said fixed jaw, and means on said arm for moving a movable jaw toward and away from said fixed jaw to hold and release a workpiece disposed between said jaws;

a second clamping means including a second upstanding fixed jaw adjacent said first fixed jaw, a second base arm extending longitudinally from said second fixed jaw and forming a right angle with said first base arm, and second means on said second arm for moving a second movable jaw toward and away from said second fixed jaw to hold and release a second workpiece disposed between said jaws;

said first and second fixed jaws being formed integrally with one another and comprising a solid square post upstanding from said arms at the intersection thereof; and an indexable anvil comprising a plurality of interally facing external clamping faces having generally non-planar surfaces for cooperating with said movable jaws to hold irregularly shaped workpieces and a square shaped vertical passage through said anvil sized to be slidably disposed over said integral fixed jaws, whereby said anvil can be selectively disposed over said fixed jaws in a plurality of positions for holding said workpieces.

5. A clamping device as set forth in claim 4 wherein at least one of said external faces of said anvil includes an elongated V-shaped recess for cooperating with a workpiece having a generally cylindrical external shape.

6. A clamping device as set forth in claim 4 wherein at least one of said external faces of said anvil is generally convex for engaging at workpiece having a generally concave external surface.

7. A clamping device as set forth in claim 4 wherein at least one of said external faces of said anvil includes a generally conical recess for engaging a workpiece having a generally convex external surface.

* * * * *